US005344009A

United States Patent [19]

Choi

[11] Patent Number: 5,344,009

[45] Date of Patent: Sep. 6, 1994

[54] WIRELESS REMOTE CONTROL PANEL HOUSING ASSEMBLY

[76] Inventor: Mansung Choi, 54 E. 8th St., #6L, New York, N.Y. 10003

[21] Appl. No.: 970,567

[22] Filed: Nov. 3, 1992

[51] Int. Cl.[5] ..... B65D 85/38; B65D 21/02

[52] U.S. Cl. ..... 206/305; 206/320; 220/23.4; 220/241; 220/327; 220/533; 340/825.72; 359/146; 359/148

[58] Field of Search ..... 206/305, 320; 312/108, 312/111; 359/142, 146, 148; 340/825.69, 825.72; 220/23.4, 241, 287, 327, 529, 530, 532, 533

[56] References Cited

U.S. PATENT DOCUMENTS 4,809,360 2/1989 Kraft ..... 359/142 X
4,836,256 6/1989 Meliconi ..... 206/305 X
4,949,843 8/1990 Stokes ..... 206/305

FOREIGN PATENT DOCUMENTS 828405 12/1951 Fed. Rep. of Germany ..... 220/23.4
1139998 11/1962 Fed. Rep. of Germany ..... 220/23.4

*Primary Examiner*—Bryon P. Gehman
*Attorney, Agent, or Firm*—Robert W. J. Usher

[57] ABSTRACT

A portable remote control panel of variable size comprises a series of modular housing meanders each having a compartment adjustable in size for receiving a respective remote controller, an operating window at an operating face, and a control beam-admitting window at a leading end. The housing members are releasably linked together locating individual remote controllers arrayed in side-by-side relation with control buttons thereof exposed at the respective windows at the operating face and with the leading, beam-emitting ends aligned with the respective beam-admitting windows.

27 Claims, 1 Drawing Sheet

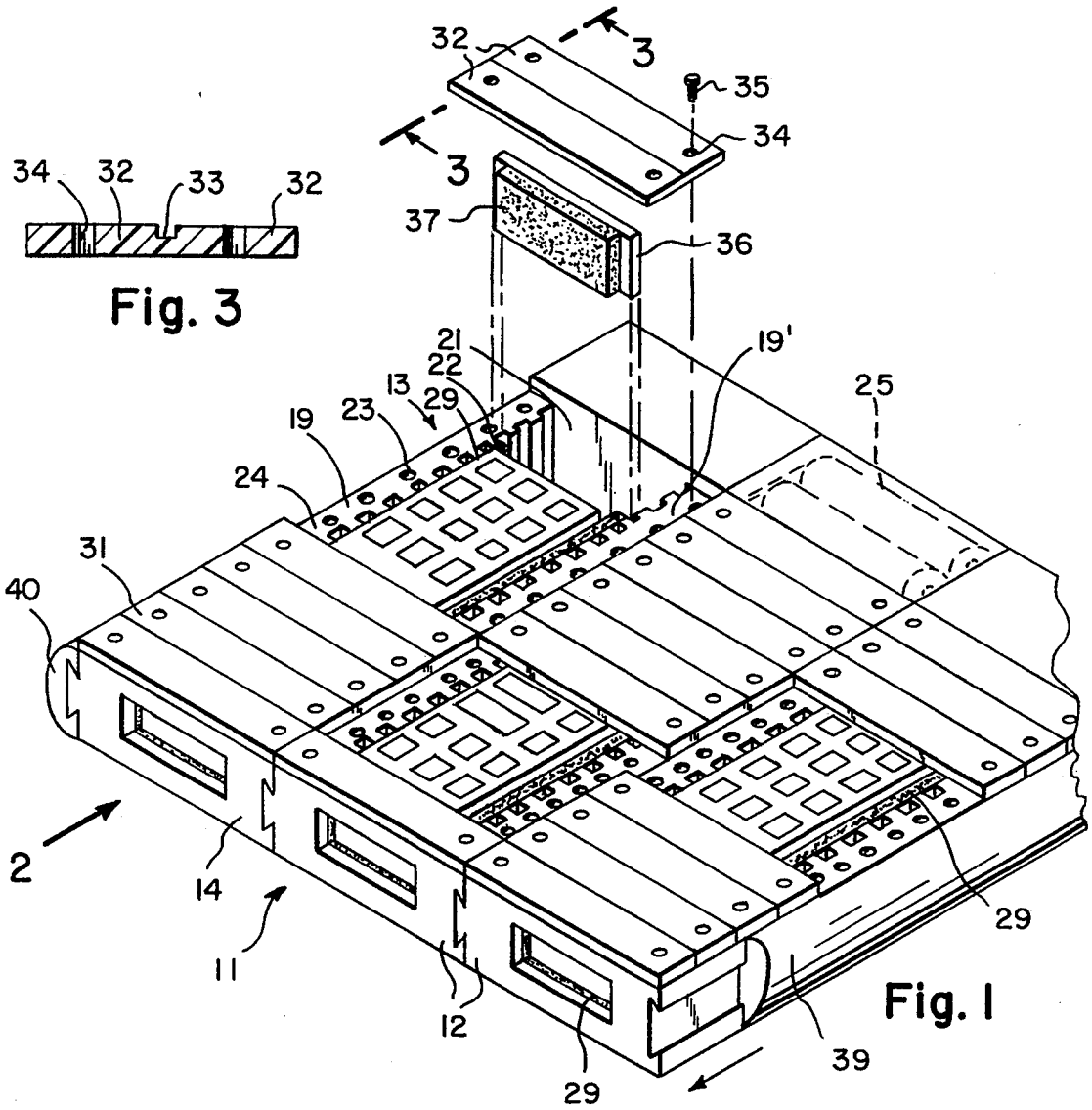
Fig. 1
Fig. 3
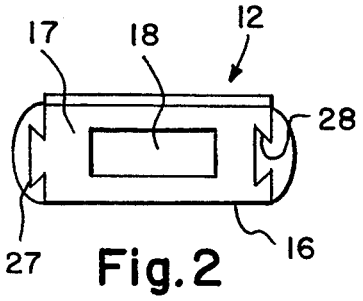
Fig. 2
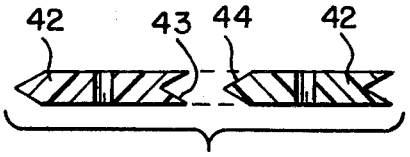
Fig. 4

WIRELESS REMOTE CONTROL PANEL HOUSING ASSEMBLY

FIELD OF THE INVENTION

The invention relates to wireless remote control and particularly to a portable remote control panel assembly comprising a plurality of individual wireless remote controllers for electronic equipment.

BACKGROUND OF THE INVENTION

Hand-held, wireless remote controllers are well known and widely used in the home for operating various kinds of electronic equipment such as TV, VCR, CD Players and Tuners etcetera. Frequently, a single remote controller may be used to operate any of the individual items of equipment separately or, when connected together to form for example a sound system, by activation of the amplifier or tuner.

However, commonly, individual items of electronic equipment found in the home are made by different manufacturers having been purchased over an extended period or having been selected on the basis of preferred quality.

As a result, different remote controllers may be required for each item of equipment which results in inconvenience in locating the appropriate controller when it is desired to operate a particular item of equipment and, furthermore, attempts may be made to operate an item of equipment using an unsuitable controller as it can be difficult to identify the appropriate controller at a glance, requiring close inspection, which can be time-consuming and irritating for the user. Different remote controllers also vary in size and location of the control buttons thereof.

Thus, where multiple items of different electronic equipment are used in the home, the advantages of convenience normally occurring from wireless remote control may be lost.

SUMMARY OF THE INVENTION

It is an object of the invention to obviate the above-noted disadvantages by providing a wireless, remote control panel having compartments for receipt of individual remote controllers to retain them together in operative condition at a single location.

It is a further object of the invention to provide a modular control panel, the respective modules of which can be assembled together as desired to provide a control panel assembly of any required size accommodating the required number of different remote controllers for use.

According to one aspect of the invention, there is provided a portable remote control panel for wireless remote control of domestic electronic equipment comprising a housing assembly having an operating face and a leading end and comprising means defining a series of wireless remote controller receiving compartments with apertures at the operating face and beam admitting windows at the leading end; means for adjusting the size of the respective compartments and means for retaining individual remote controllers in respective compartments so that the individual remote controllers are arrayed in side-by-side relation with control buttons thereof exposed at the respective windows in the operating face and with the leading, beam emitting ends aligned with the respective beam admitting windows.

Preferably, the compartment defining means comprises a plurality of elongate modules each providing an individual compartment and means for attaching the individual modules together, side-by-side, in substantially coplanar relation enabling the control panel to be constructed to any desired size.

Desirably, the attachment means comprises complementary, intermatable tongue and groove members extending along respective opposite longitudinal sides of respective modules enabling simple manual assembly in the home by an unskilled person.

The panel may include trim means comprising trim strips formed, respectively, with complementary tongues and grooves for mating engagement with groove and tongue members, respectively, of endmost housing modules enabling an aesthetically attractive appearance to be obtained irrespective of final control panel size in equally simple fashion.

In a preferred embodiment, each compartment has opposite, elongate side walls which extend away from the operating face and in which the means for adjusting the compartment size comprises a series of grooves in the side walls and extending away from the operating face and a partition member receivable in selected grooves to extend across the compartment thereby to adjust the length of the compartment and for engagement with a rear end of an individual remote controller received in the compartment.

Thus, individual compartments can be quickly and simply matched in size with respective controllers of different sizes.

The retaining means may comprise a series of modular cover strip members and means, such as screws for anchoring respective cover strip members in respective holes of a series of holes formed at spaced apart intervals along opposite side walls to define respective apertures enabling speedy and simple assembly.

Desirably, resiliently compressible cushioning means lines respective compartments ensuring reception of respective remote controllers as snug fits therein and providing additional protection against impact damage of particular importance when children are in the home.

In one embodiment, at least one auxiliary battery compartment is provided adjacent the end of at least one remote controller compartment.

In one advantagous construction, individual cover strip members are frangibly attached together by a weakened portion, breakable to form at least one cover strip member of desired length.

Preferably, each cover strip member is formed with intermatable tongues and grooves on respective opposite longitudinal edge portions thereof for mating with complementary grooves and tongues of an adjacent cover strip member with the cover strip members in edge-to-edge relation providing a substantially flat or unbroken surface when attached together.

According to another aspect, the invention provides a kit for assembling a portable remote control panel of varying size for wireless remote control of domestic electronic equipment comprising a series of elongate modular housing members each having a compartment opening to a front, operating face and a control beam admitting window at a leading end; means for adjusting the size of each compartment for receiving respective remote controllers of different sizes; means for retaining respective remote controllers in respective compartments and means for attaching respective modular housing members together in side-by-side, coplanar relation so that the individual remote controllers are arrayed in side-by-side relation with control buttons thereof exposed at the respective windows in the operating face and with the leading, beam emitting ends aligned with the respective beam admitting windows.

BRIEF DESCRIPTION OF THE DRAWINGS

A specific embodiment of the invention will now be described by way of example only and with reference to the accompanying drawings in which:

FIG. 1 is a partly exploded, isometric view of a portable, wireless remote control panel assembly erected from a kit, according to the invention;

FIG. 2 is an elevational view of a leading end of an individual housing module of the control panel assembly;

FIG. 3 is a cross-sectional view taken along the line 3—3 of FIG. 1 showing a composite strip of remote controller-retaining cover members; and FIG. 4 is a cross-sectional view of an alternative modular cover member.

BRIEF DESCRIPTION OF THE PREFERRED EMBODIMENT

A remote control panel assembly 11 includes a series of modular housing members 12 attached together to provide a front, operating face 13 and a leading, control beam emitting end 14. Each housing member 11 is an elongate, substantially tray-like structure having an imperforate floor 16, a front wall 17 formed with a central, control beam admitting window 18, opposite side walls 19, 19', upstanding from the floor and defining an aperture 21 at the front, operating face.

A series of grooves 22 extend along the inner opposed surfaces of each side walls 19, 19' and, optionally, a series of anchoring apertures 23 are formed along front edge portions 24 of the side walls. An auxiliary battery compartment 25 is formed at the rear end of each remote controller-receiving compartment.

Intermatable male and female attachment portions 27 and 28 of complementary shape extend along the outside of each side wall.

A resiliently compressible cushioning lining 29 of synthetic foam extends along the floor, side walls and end wall of each compartment.

A composite cover member strip 31 comprises a series of individual, modular retaining, strip-like cover members 32 attached in edge-to-edge relation by a weakened portion 33 so that a selected number of individual modular strips can be broken away from the composite strip to provide one or more cover member portions of desired size. Each end of each cover member 32 is formed with an aperture 34 for receiving a retaining screw 35.

A rectangular partition member 36 has a foam cushion 37 attached to one face thereof and is receivable in any selected pair of opposed grooves to define a controller-receiving compartment matched in size to the controller to be received therein.

A pair of decorative trim strips 39, 40 are formed with dovetaill, male and female, linking sections for mating with endmost modules.

In an alternative embodiment shown in FIG. 4, the individual retaining strip members may be formed with mateable longitudinal edge portions of complementary shape for edge-to-edge mating engagement to provide a cover of any desired length and having a smooth and unbroken surface.

The strip members, partitions and housings may be made of any suitable material such as wood or plastic.

The control panel is assembled from a kit comprising three or more modular housings, composite strips of retaining cover members, a series of partition members, additional plastic foam sheet, screws which may, advantageously, be self-tapping obviating need for apertures in the side walls thereby improving the appearance and, two, complementary trim members.

In assembling the control panel from the strip, the remote controllers are inserted as a snug fit in respective compartments with their control buttons 45 uppermost at the control face and their beam emitting ends adjacent and aligned with the respective windows. The respective partitions are then inserted into the appropriate groove so that their foam portions urge the controllers against the foam-lined leading end wall preventing lateral or longitudinal movement of the controller. An appropriate number of retaining members are broken from the composite strip and secured by the screws to the side walls extending over the controller, both securing the controller in the compartment and covering unoccupied areas of the housing face defining apertures 49 through which the control buttons 45 are exposed.

Individual modules are then mated together, edge-to-edge by a relative sliding action to define the control panel with all apertures at the front base thereof and with windowed leading ends adjacent.

The trim is then applied to the dove-tailed portions of endmost modules to improve the appearance thereof.

A series of self adhesive labels having designations of different equipment types such as TV, VCR1, TUNER1, may be included in the kit for attachment to respective modules enabling the appropriate sets of control buttons to be identified at a glance.

I claim:

1. A portable remote control panel for wireless remote control of domestic electronic equipment comprising a housing assembly having an operating face and a leading end and comprising means defining a series of elongate wireless remote controller-receiving compartments with apertures at the operating face and beam-admitting windows at the leading end; moveable partition means in each compartment for adjusting the longitudinal sizes of the respective compartments for receiving remote controllers of different lengths and means for retaining individual remote controllers in respective compartments so that the individual remote controllers are arrayed in side-by-side relation with control buttons thereof exposed at respective apertures in the operating face and with leading, beam-emitting ends aligned with the respective beam-admitting windows.

2. A portable remote control panel according to claim 1 in which the compartment-defining means comprises a plurality of elongate modules each providing an individual compartment and means for attaching the individual modules together, side-by-side, in substantially coplanar relation.

3. A portable remote control panel according to claim 2 in which the attachment means comprises complementary, intermatable tongue and groove members extending along respective opposite longitudinal sides of respective modules.

4. A portable remote control panel according to claim 3 including trim means for mounting on unmated means for attaching the modules together comprising trim strips formed, respectively, with complementary tongues and grooves for mating engagement with groove and tongue members, respectively, of endmost housing modules.

5. A portable remote control panel according to claim 1 in which each compartment has opposite, elongate side walls which extend away from the operating face and in which the means for adjusting the compartment size comprises a series of grooves in the side walls and extending away from the operating face and a partition member receivable in selected grooves to extend across the compartment thereby to adjust the length of the compartment and for engagement with a rear end of an individual remote controller received in the compartment.

6. A portable remote control panel according to claim 5 in which the retaining means comprises a series of modular cover-strip members and means to anchor respective cover strip members in respective holes of a series of holes formed at spaced apart intervals along opposite side walls to define respective apertures.

7. A portable remote control panel according to claim 6 in which individual cover strip members are frangibly attached together by a weakened portion, breakable to form at least one cover strip member of desired length.

8. A portable remote control panel according to claim 7 in which each cover strip member is formed with intermatable tongues and grooves on respective opposite longitudinal edge portions thereof for mating with complementary grooves and tongues of an adjacent cover strip member with the cover strip members in edge-to-edge relation.

9. A portable remote control panel according to claim 1 in which each compartment has opposite side walls extending away from the operating face and the retaining means comprises a series of modular cover strip members and means to anchor respective cover strip members in respective holes of a series of holes formed at spaced apart intervals along opposite side walls to define respective apertures.

10. A portable remote control panel according to claim 1 in which resiliently compressible cushioning means lines respective compartments ensuring reception of respective remote controllers as snug fits therein.

11. A portable remote control panel according to claim 1 in which at least one auxiliary battery compartment is provided adjacent the end of at least one remote controller compartment.

12. A kit for assembling a portable remote control panel of varying size for wireless remote control of domestic electronic equipment comprising a series of elongate modular housing members each having an elongate compartment with an aperture at a front, operating face and a control beam-admitting window at a leading end; movable partition means in each compartment for adjusting the longitudinal size of each compartment for receiving respective remote controllers of different sizes; means for retaining respective remote controllers in respective compartments and means for attaching respective modular housing members together in side-by-side, coplanar relation so that the individual remote controllers are arrayed in side-by-side relation with control buttons thereof exposed at respective apertures in the operating face and with leading, beam-emitting ends aligned with the respective beam-admitting windows.

13. A kit according to claim 12 in which the attachment means comprises complementary, intermatable tongue and groove members extending along respective opposite longitudinal sides of respective modules.

14. A kit according to claim 13 including trim means for mounting on unmated attachment means comprising trim strips formed, respectively, with complementary tongues and grooves for mating engagement with groove and tongue members, respectively, of endmost housing modules.

15. A kit according to claim 12 in which each compartment has opposite, elongate side walls which extend away from the operating face and in which the means for adjusting the compartment size comprises a series of grooves in the side walls and extending away from the operating face and a partition member receivable in selected grooves to extend across the compartment thereby to adjust the length of the compartment and for engagement with a rear end of an individual remote controller received in the compartment.

16. A kit according to claim 15 in which the retaining means comprises a series of modular cover-strip members and means to anchor respective cover strip members in respective holes of a series of holes formed at spaced apart intervals along opposite side walls to define respective apertures.

17. A kit according to claim 15 in which individual cover strip members are frangibly attached together by a weakened portion, breakable to form at least one cover strip member of desired length.

18. A kit according to claim 12 in which resiliently compressible cushioning means lines respective compartments ensuring reception of respective remote controllers as snug fits therein.

19. A kit according to claim 12 in which at least one auxiliary battery compartment is provided adjacent the end of at least one remote controller compartment.

20. A portable remote control panel for wireless remote control of domestic electronic equipment comprising a housing assembly having an operating face and a leading end and comprising means defining a series of wireless remote controller receiving compartments which have apertures at the operating face, beam-admitting windows at the leading end and opposite side walls extending away from the operating face; and means for retaining individual remote controllers in respective compartments comprising a series of modular cover strip members and means to anchor respective cover strip members in respective holes of a series of holes formed at spaced apart intervals along opposite side walls to define respective apertures, so that individual remote controllers received therein are arrayed in side-by-side relation with control buttons thereof exposed at respective apertures in the operating face and with leading, beam-emitting ends aligned with the respective beam-admitting windows.

21. A portable remote control panel according to claim 20 in which individual cover strip members are frangibly attached together by a weakened portion, breakable to form at least one cover strip member of desired length.

22. A portable remote control panel according to claim 21 in which each cover strip member is formed with intermatable tongues and grooves on respective opposite longitudinal edge portions thereof for mating with complementary grooves and tongues of an adjacent cover strip member with the cover strip members in edge-to-edge relation 23. A portable remote control panel according to claim 20 in which means are provided for adjusting the sizes of respective compartments for receiving respective remote controllers of different sizes

24. A kit for assembling a portable remote control panel of varying size for wireless remote control of domestic electronic equipment comprising a series of elongate modular housing members each having a compartment which has an aperture at a front, operating face and opening to a control beam-admitting window at a leading end and has opposite side walls extending away from the operating face; and means for retaining individual remote controllers in respective compartments comprising a series of modular cover strip members and means to anchor respective cover strip members in respective holes of a series of holes formed at spaced apart intervals along opposite side walls to define respective apertures; and means for attaching respective modular housing members together in side-by-side, coplanar relation so that retained individual remote controllers are arrayed in side-by-side relation with control buttons thereof exposed at respective apertures in the operating face and with leading, beam-emitting ends aligned with the respective beam-admitting windows.

25. A kit according to claim 24 in which individual cover strip members are frangibly attached together by a weakened portion, breakable to form at least one cover strip member of desired length.

26. A kit according to claim 25 in which each cover strip member is formed with intermatable tongues and grooves on respective opposite longitudinal edge portions thereof for mating with complementary grooves and tongues of an adjacent cover strip member with the cover strip members in edge-to-edge relation.

27. A portable remote control panel according to claim 24 in which means are provided for adjusting the sizes of respective compartments for receiving respective remote controllers of different sizes.

* * * * *